US010729204B2

(12) United States Patent
Lassally

(10) Patent No.: US 10,729,204 B2
(45) Date of Patent: Aug. 4, 2020

(54) HELMET REMOVAL SYSTEM AND METHOD

(71) Applicant: Teodoro Lassally, Port Orange, FL (US)

(72) Inventor: Teodoro Lassally, Port Orange, FL (US)

(73) Assignee: ROUX TRADING, INC., Miami, FL (US)

( * ) Notice: Subject to any disclaimer, the term of this patent is extended or adjusted under 35 U.S.C. 154(b) by 41 days.

(21) Appl. No.: 15/534,847

(22) PCT Filed: Dec. 10, 2015

(86) PCT No.: PCT/US2015/064997

§ 371 (c)(1),
(2) Date: Jun. 9, 2017

(87) PCT Pub. No.: WO2016/094656

PCT Pub. Date: Jun. 16, 2016

(65) Prior Publication Data

US 2018/0263327 A1 Sep. 20, 2018

Related U.S. Application Data

(60) Provisional application No. 62/090,252, filed on Dec. 10, 2014.

(51) Int. Cl.
*A42B 3/32* (2006.01)
*A42B 3/10* (2006.01)

(52) U.S. Cl.
CPC ..... *A42B 3/328* (2013.01); *A42B 3/10* (2013.01)

(58) Field of Classification Search
CPC .. A42B 3/328; A42B 3/10; A42B 3/14; A42B 3/04; A42B 3/0406; A42B 3/105;
(Continued)

(56) References Cited

U.S. PATENT DOCUMENTS 2,184,043 A * 12/1939 Heilstedt ..... A42B 3/10 2/202
2,286,843 A * 6/1942 Catalane ..... A42B 3/10 2/410

(Continued)

FOREIGN PATENT DOCUMENTS

DE 102010022772 A1 9/2011
JP 2005054300 A 3/2005

(Continued)

OTHER PUBLICATIONS

English language machine translation of JP 2005054300 A (Pub. Mar. 2005), 11 pgs (Year: 2005).*

(Continued)

*Primary Examiner* — Amy Vanatta
(74) *Attorney, Agent, or Firm* — Kramer Amado, P.C.

(57) ABSTRACT

A helmet removal system includes a detachable helmet liner configured to be positioned in a helmet. The helmet liner includes a central portion configured to receive a user's head therein, a frontal portion integrally formed with the central portion and configured to engage a user's frontal head portion. The helmet liner further includes dual side tab portions integrally formed with the central portion. The dual tab portions are configured to be moved between a folded position, inside of the helmet, to an unfolded position. The helmet liner further includes a top portion extending between opposing edges of the central portion. The helmet liner also includes a rear portion integrally connected to the central portion to provide balanced engagement with the back of a user's head. Helmet removal is achieved by applying lateral pulling forces to the dual tab portions.

11 Claims, 7 Drawing Sheets

(58) Field of Classification Search
CPC ..... A42B 1/041; A42B 1/066; A42B 3/22; A42B 1/06
See application file for complete search history.

(56) References Cited

U.S. PATENT DOCUMENTS 2,339,080 A * 1/1944 Karabin ..... A42B 3/10 2/410
3,205,508 A * 9/1965 Cox ..... A42B 3/105 2/172
3,366,971 A * 2/1968 Scherz ..... A42B 3/10 112/420
3,594,814 A * 7/1971 Schuessler ..... A42B 3/105 2/205
4,397,045 A * 8/1983 Schonwetter ..... A42B 3/16 2/172
4,951,319 A 8/1990 Phillips et al.
7,854,023 B2 * 12/2010 Ando ..... A42B 3/328 2/414
2014/0059746 A1 3/2014 Velasco
2016/0278464 A1 * 9/2016 Morizot ..... A42B 3/105

FOREIGN PATENT DOCUMENTS

WO WO-2011047283 A1 * 4/2011 ..... A42B 3/328
WO WO-2011047284 A1 * 4/2011 ..... A42B 3/328

OTHER PUBLICATIONS

Supplementary European Search Report dated Jul. 3, 2018 in connection with corresponding European Application No. 15867637.9.
International Preliminary Report on Patentability dated Jun. 13, 2017 in PCT/US2015/064997 filed Dec. 10, 2015.

* cited by examiner

HELMET REMOVAL SYSTEM AND METHOD

TECHNICAL FIELD

Various exemplary embodiments disclosed herein relate generally to a helmet removal system and, more particularly, to a helmet removal system including a helmet liner configured to eject the user's head from a helmet by distributing forces applied to the helmet liner to the helmet and user's head.

BACKGROUND

One of the most important aspect of sports is ensuring safety to the participants. This is especially true for contact sports, such as skiing, car racing, football, and hockey, for example, which require participants to wear helmets to prevent catastrophic head injuries. Helmets are designed to protect the user's head from impacting objects. Most helmets are designed to provide a snug fit between the user's head and the helmet to reduce movement of the user's head inside of the helmet during use.

Occasionally, participants wearing helmets and partaking in sports are injured and require medical attention. In such cases, individuals, such as emergency personnel, may need to remove the participant's helmet and safety gear in order to administer effective medical care. As such, the emergency personnel typically removes the helmet from the user (in a laying position) by applying a pulling force on the helmet, longitudinal to the person's body and neck, to slide the helmet off of the user.

Because of the tight fit between the helmet and the user's head, upon attempted movement of the helmet from the head, frictional forces typically exist between the user's head and the interior of the helmet. As such, frictional counterforces may obstruct or prevent the helmet from being slid off of the user's head easily. As a result, the safety personnel may need to exert enhanced force to the helmet. This enhanced force may be transferred to the head, as well as the neck, causing further injury to the injured individual.

Human anatomy provides that seven (7) cervical vertebrae form the bones of the neck that support the skull and organs of the head. The first cervical vertebra (atlas) supports and balances the head. The second vertebra (axis) allows the head to rotate laterally to the left and the right. Hollow spaces within the cervical vertebrae protect and conduct the spinal cord and vertebral arteries through the neck. Muscle attachment sites on the cervical vertebrae provide movement and posture to the head and neck.

By pulling on the head or helmet to remove the helmet from the injured individual, the emergency personnel may cause further permanent damage to the bones and neck supporting the skull and organs of the head, such as paralysis or death. Accordingly, the act of pulling a helmet off of a user longitudinally, providing a separating force, is highly discouraged. Unfortunately, during an emergency, helmet removal from the injured individual may be totally essential to provide the user with effective medical treatment.

SUMMARY

A brief summary of various exemplary embodiments is presented below. Some simplifications and omissions may be made in the following summary, which is intended to highlight and introduce some aspects of the various exemplary embodiments, but not to limit the scope of the invention. Detailed descriptions of a preferred exemplary embodiment adequate to allow those of ordinary skill in the art to make and use the inventive concepts will follow in later sections.

The helmet removal system facilitates removal of a helmet from a user's head without requiring pulling forces to be applied to the head and helmet. The helmet removal system includes a removably detachable helmet liner configured to be positioned in the helmet. The helmet liner includes a central portion configured to receive a user's head therein, and a frontal portion integrally formed with the central portion and configured to engage the user's frontal head portion. The helmet liner further includes dual side tab portions also integrally formed with the central portion. The dual side tab portions are flexibly configured to be moved between a folded position for storage inside of the helmet to an unfolded position outside of the helmet.

The helmet liner of the helmet removal system further includes a top portion extending between opposing top edges of the central portion. The top portion is configured to engage the top portion of the users head and apply a longitudinal force in a second direction when the helmet liner tab portions are pulled laterally during helmet removal. The helmet liner further includes a rear portion integrally connected to the central portion to provide a balancing engagement with the back of a user's head. The rear portion further prevents displacement of the helmet liner from the head.

In operation, an individual applies lateral pulling forces to the dual tab portions of the helmet liner, in a direction generally perpendicular to user's helmet. As such, the outer surfaces of the dual tab portions engage the lower edge of the helmet. The tab portions apply a longitudinal force to the lower edge of the helmet in a first direction forcing the helmet away from the user's head. Simultaneously, the top portion of the helmet liner applies a longitudinal force on the user's head in an opposing second direction.

In various embodiments of the helmet removal system the rear portion of the helmet liner provides a balancing force to the back of the user's head preventing displacement of the head from the helmet liner, when lateral forces are applied to the dual side tab portions.

In further various embodiments of the helmet removal system, the frontal portion of the helmet liner provides a balancing force to the front of the user's head preventing migration or displacement of the helmet liner from the user's head, when lateral forces are applied to the dual side tab portions.

In further various embodiments of the helmet removal system, the dual tab portions each have rigid end portions configured for insertion between the inner shell of the helmet and the outer shell of the helmet.

In further various embodiments of the helmet removal system, the central portion of the helmet liner defines a generally circular configuration adapted to receive a user's head therein and provide a stabilizing force preventing displacement of the helmet liner from the head during helmet ejection.

In further various embodiments of the helmet removal system, the helmet liner includes a first opening is provided between the top portion and frontal portion in the helmet liner, and a second opening is provided between the top portion and the back portion.

The method of removing a helmet from a user's head, includes the steps of: providing a removably detachable helmet liner in a helmet having dual tab portions extending from the side of the helmet liner. Thereafter the method includes applying lateral pulling forces to the dual tab portions such that longitudinal forces are applied to the lower edge of the helmet in a first direction and longitudinal forces are applied to a top portion of the user's head in an opposing second direction. As such, movement of the helmet and head in opposing respective directions ejects the helmet from the user's head.

BRIEF DESCRIPTION OF THE DRAWINGS

In order to better understand various exemplary embodiments, reference is made to the accompanying drawings, wherein.

To facilitate understanding, identical reference numerals have been used to designate elements having substantially the same or similar structure or substantially the same or similar function.

DETAILED DESCRIPTION

The description and drawings merely illustrate the principles of the invention. It will thus be appreciated that those skilled in the art will be able to devise various arrangements that, although not explicitly described or shown herein, embody the principles of the invention and are included within its scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Additionally, the term, "or," as used herein, refers to a non-exclusive or (i.e., and/or), unless otherwise indicated (e.g., "or else" or "or in the alternative"). Also, the various embodiments described herein are not necessarily mutually exclusive, as some embodiments can be combined with one or more other embodiments to form new embodiments.

In providing effective medical treatment to an injured individual wearing a helmet, it is desirable to reduce any and all pulling forces applied to the individual's head and/or neck during removal of the helmet. The ability to reduce the forces applied to the head and neck can be the difference between paralysis, and even life or death. Accordingly, it is desirable to provide a helmet removal system capable of facilitating the removal of the helmet from a person's head, without applying pulling forces to the individuals head and neck.

The helmet removal system facilitates safety personnel in sliding the helmet off an individual, without pulling on the helmet and head. The helmet removal system uses a helmet liner that distributes forces exerted on the helmet liner laterally into longitudinal forces applied to the outer edges of the helmet, in a first direction, and to the top of the head, in an opposing second direction. Further the helmet liner distributes the lateral forces to the frontal region, top region and back region of the head preventing displacement or migration of the helmet liner from the head during helmet removal.

Figure 1:
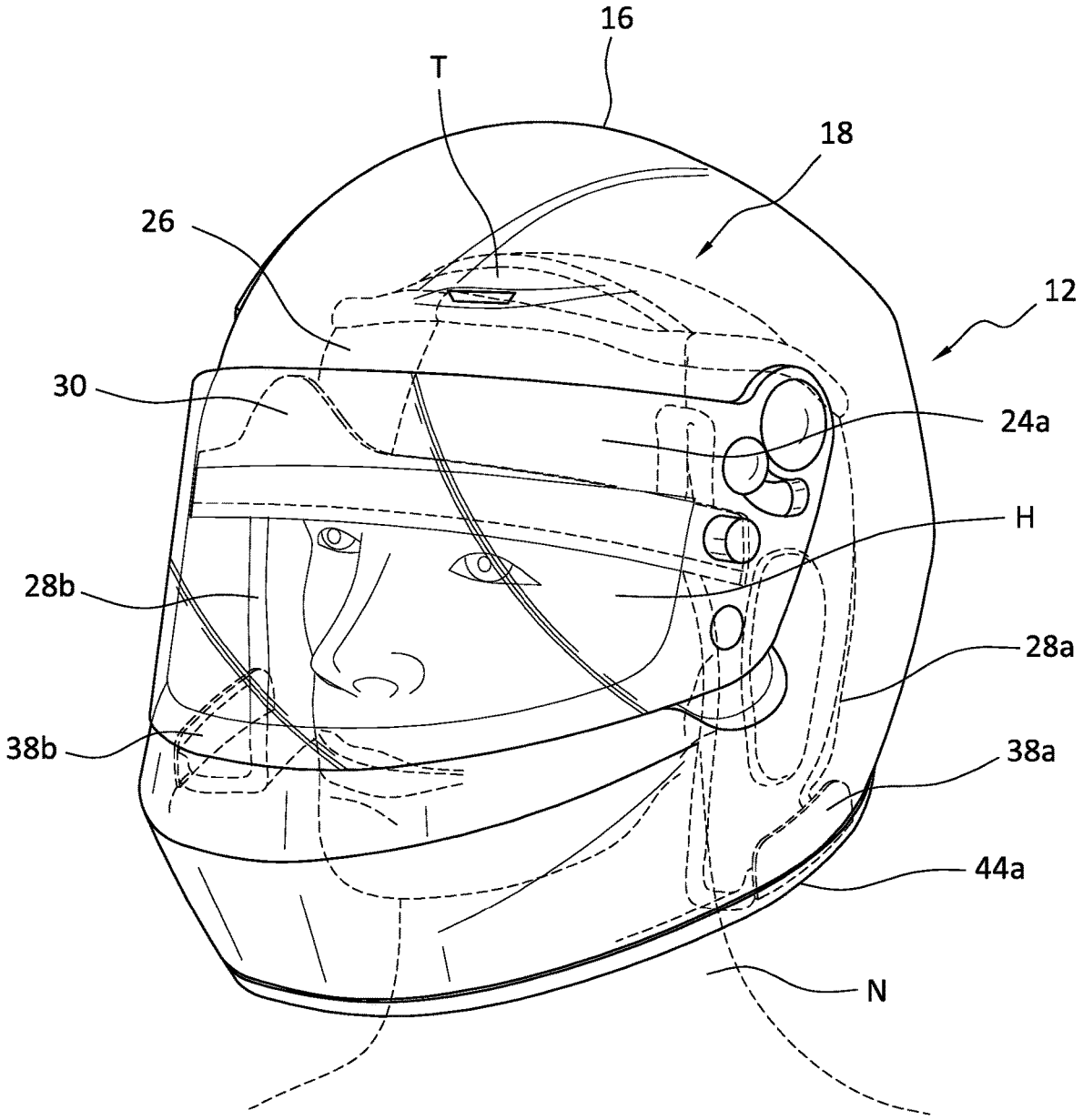
FIG. 1 illustrates the helmet removal system including a helmet liner positioned in an interior portion of a helmet.

Referring now to the drawings, wherein the illustrations are for purposes of describing one or more embodiments and not for the purposes of limiting the same, FIG. 1 illustrates an embodiment of the helmet removal system. As shown in FIG. 1, the helmet removal system is configured for cooperative engagement with a helmet 12 having an interior shell 14 (shown in FIG. 4) and an outer shell 16. The helmet removal system generally includes a removably attachable helmet liner 18 configured for integral attachment to the interior shell 14 of the helmet 12. The helmet liner 18 is configured to provide a balanced ejection force to the user's head during the helmet removal process as well as a longitudinal force in a first direction, to the outer edges 44*a* and 44*b* of the helmet 12.

Figure 2:
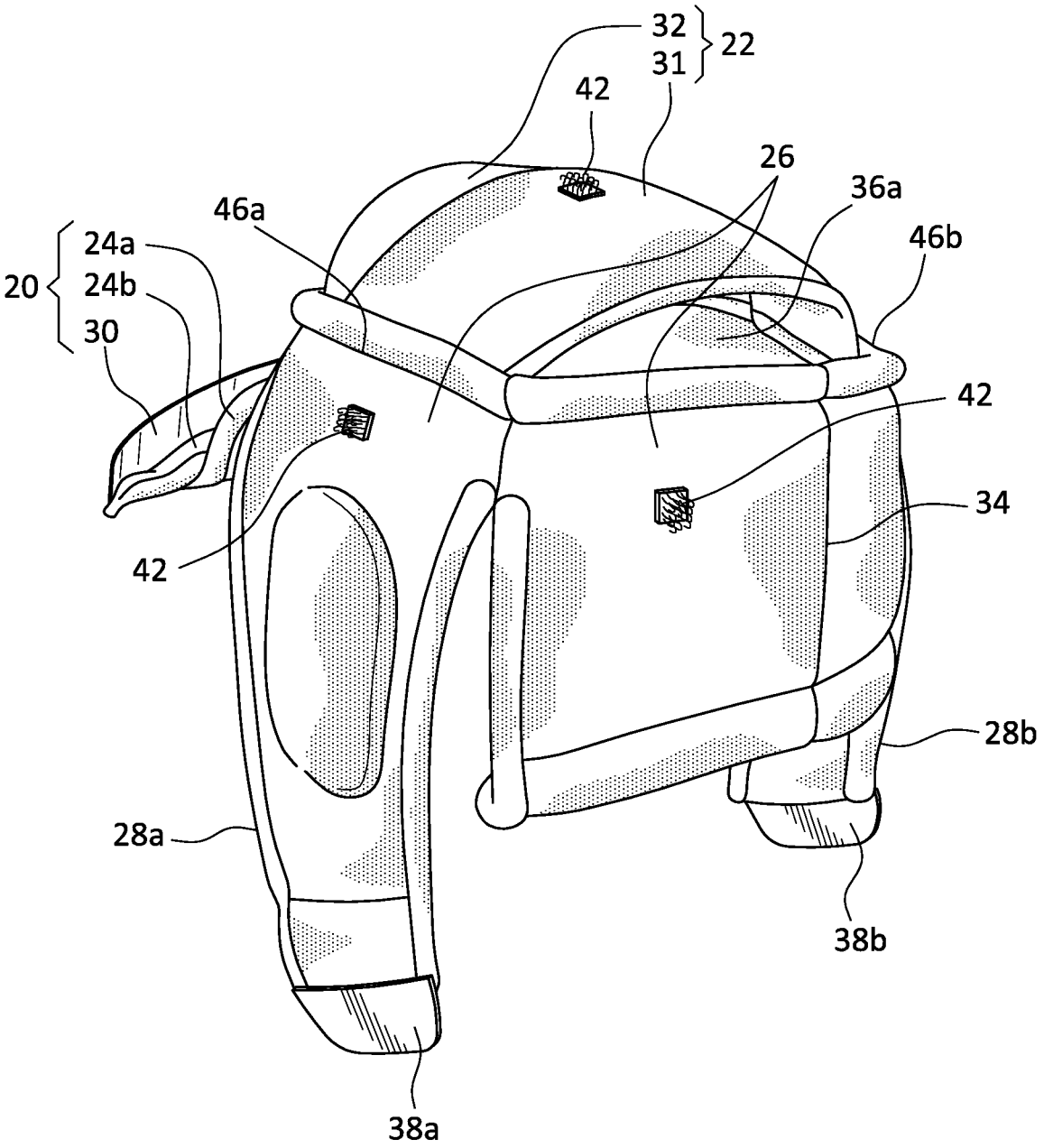
FIG. 2 is a perspective view of the helmet liner of the helmet removal system of FIG. 1, shown disconnected from the helmet.
Figure 3:
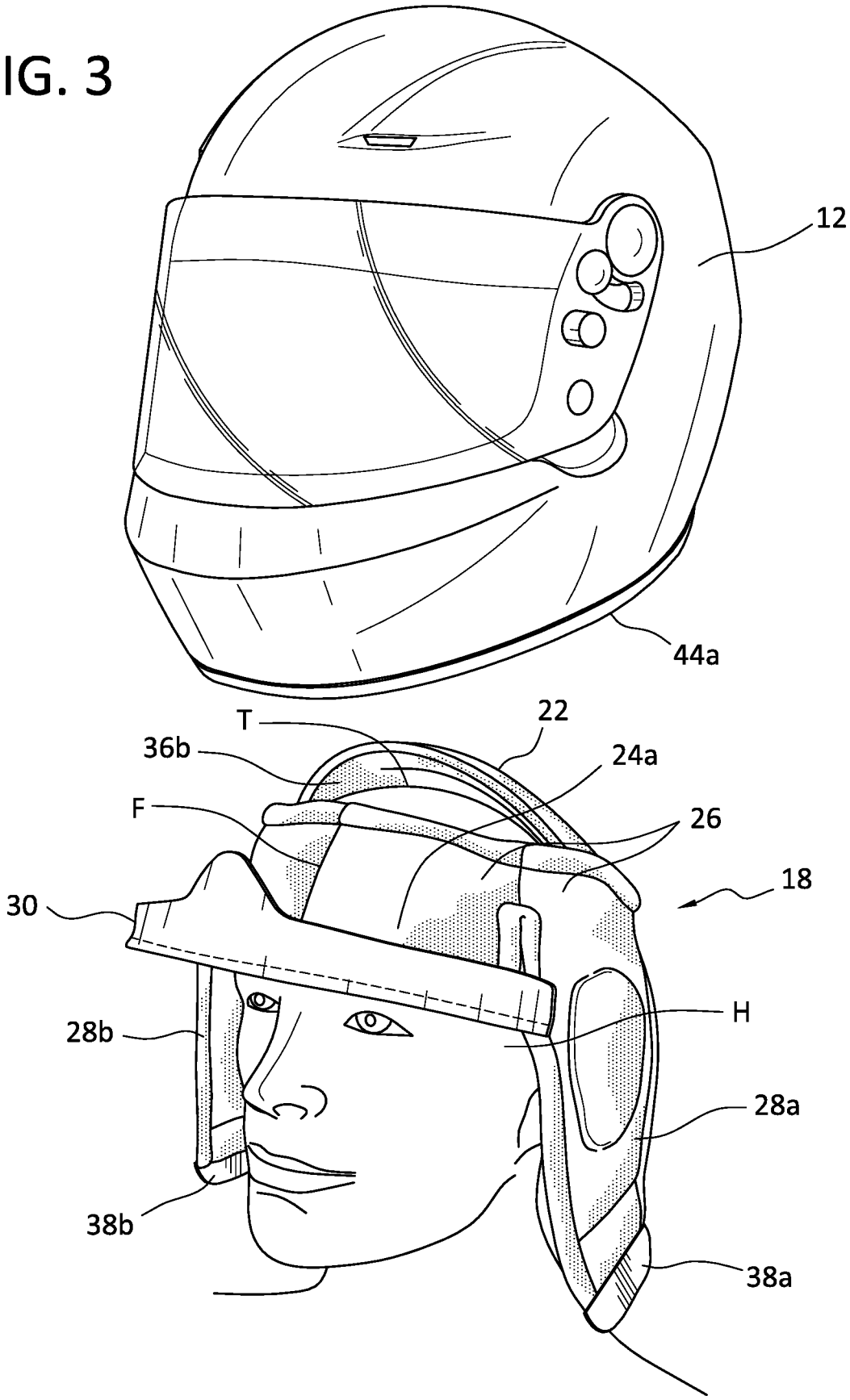
FIG. 3 is an exploded view of the helmet removal system of FIG. 1.

As shown in FIGS. 2 and 3, the helmet liner 18 generally includes a frontal portion 20 configured for engagement with the forehead portion or frontal bone region F of the user, a top portion 22 configured to engage the top head T or parietal bone region of the user's head when in the helmet 12 is in a wearing position, a rear portion 34 configured to engage the back head B of a user's head, and a generally circular central portion 26 configured to extend centrally about the perimeter of the helmet liner 18. Rear portion 34 and frontal portion 20 extend generally downward from the central portion 26 of the helmet liner 18.

The central portion 26 has a generally circular configuration, adapted to receive the circumference of the head therein. Part of the central portion 26 engages the temporal region of the user's head H. The helmet liner 18 further includes dual tab portions 28*a*, 28*b* extending generally downward from the central portion 26 of the helmet liner 18.

The frontal portion 20 has a frontal band portion 24*a* connected to the central portion 26 of the helmet liner 18, and a flexible extension 24*b* extending generally from the frontal band portion 24*a* and a fastening member 30. The fastening member 30 has a generally rigid curved configuration, adapted for insertion into a space or opening formed between the helmet interior shell 14 and the helmet exterior shell 16. As such, the fastening member 30 connects the helmet liner 18 to the frontal interior of the shell. The flexible extension 24*b* between the frontal band portion 24*a* and fastening member 30 permits the helmet liner 18 to flexibly fit within the helmet 12. During the helmet removal phase, the frontal portion 20 is configured to apply a stabilizing frontal force F to the wearer's forehead, preventing migration of the helmet liner 18 from the head H.

The top portion 22 is connected to the central portion 26 and extends between opposing sides of upper edge 46 of the generally circular central portion 26. The top portion 22 is formed with a generally flexible material. The top portion 22 has a first section 31 having a curved outer edge configured to engage the interior shell 14, and a second section 32. As such, the helmet liner 18 provides a first opening 36*b* formed between the top portion 22 and the frontal portion 20 providing flexibility and ventilation.

The rear portion 34 is integrally formed with the central portion 26 and extends from the central portion 26. The rear portion 34 is configured to engage the back portion of the user's head. The rear portion 34 and central portion 26 are integrally formed and adapted to cooperatively provide a stabilizing force to the back of the head during the helmet removal process, to prevent migration or displacement of the helmet liner 18 from the head H. As shown an opening 36*a* is formed between the rear portion 34 and the top portion 22 to provide ventilation and flexibility.

Figure 4:
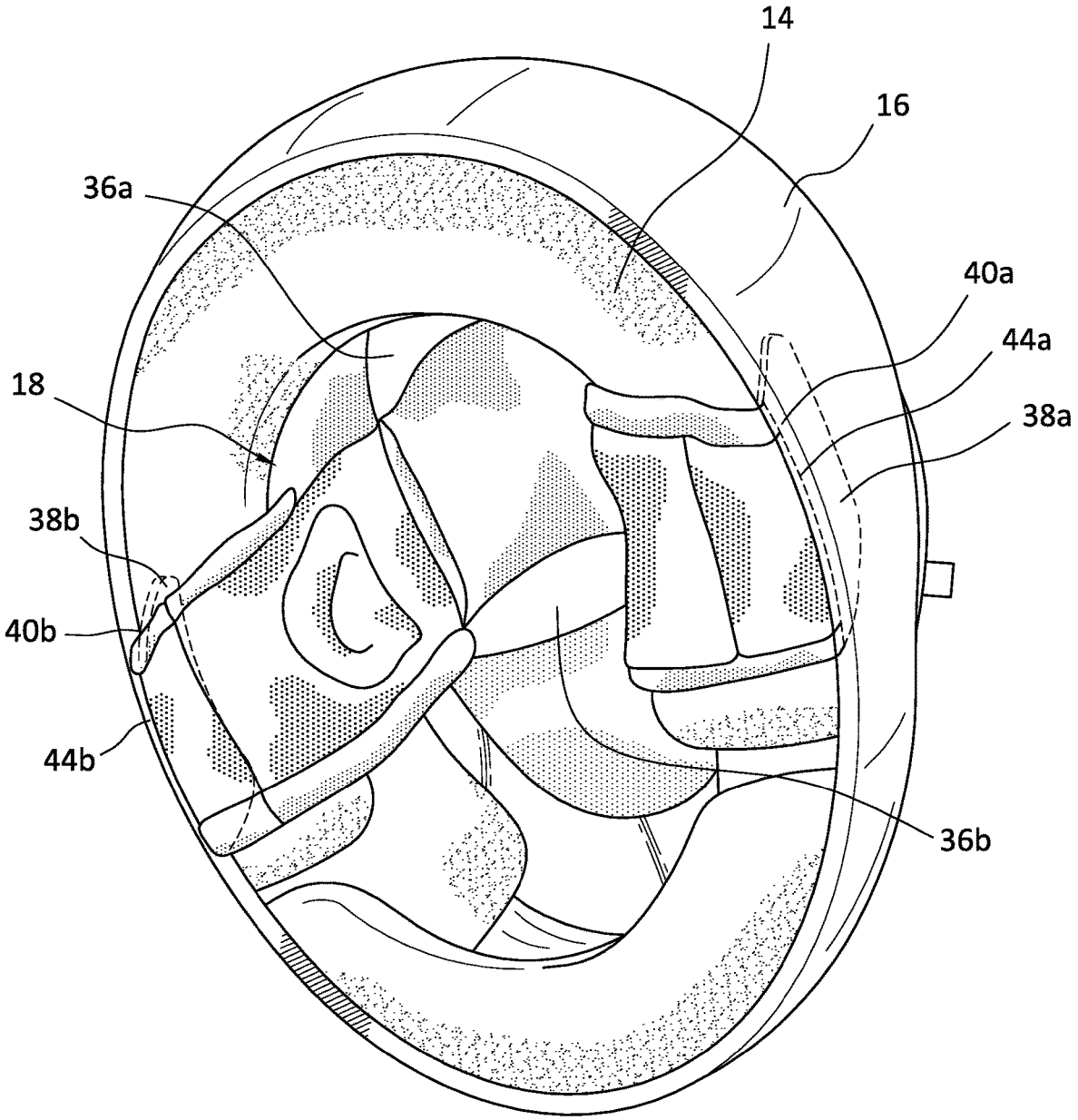
FIG. 4 is an environmental interior view of the helmet removal system of FIG. 1, illustrating the helmet liner of the helmet removal system positioned in an interior portion of the helmet.
Figure 5:
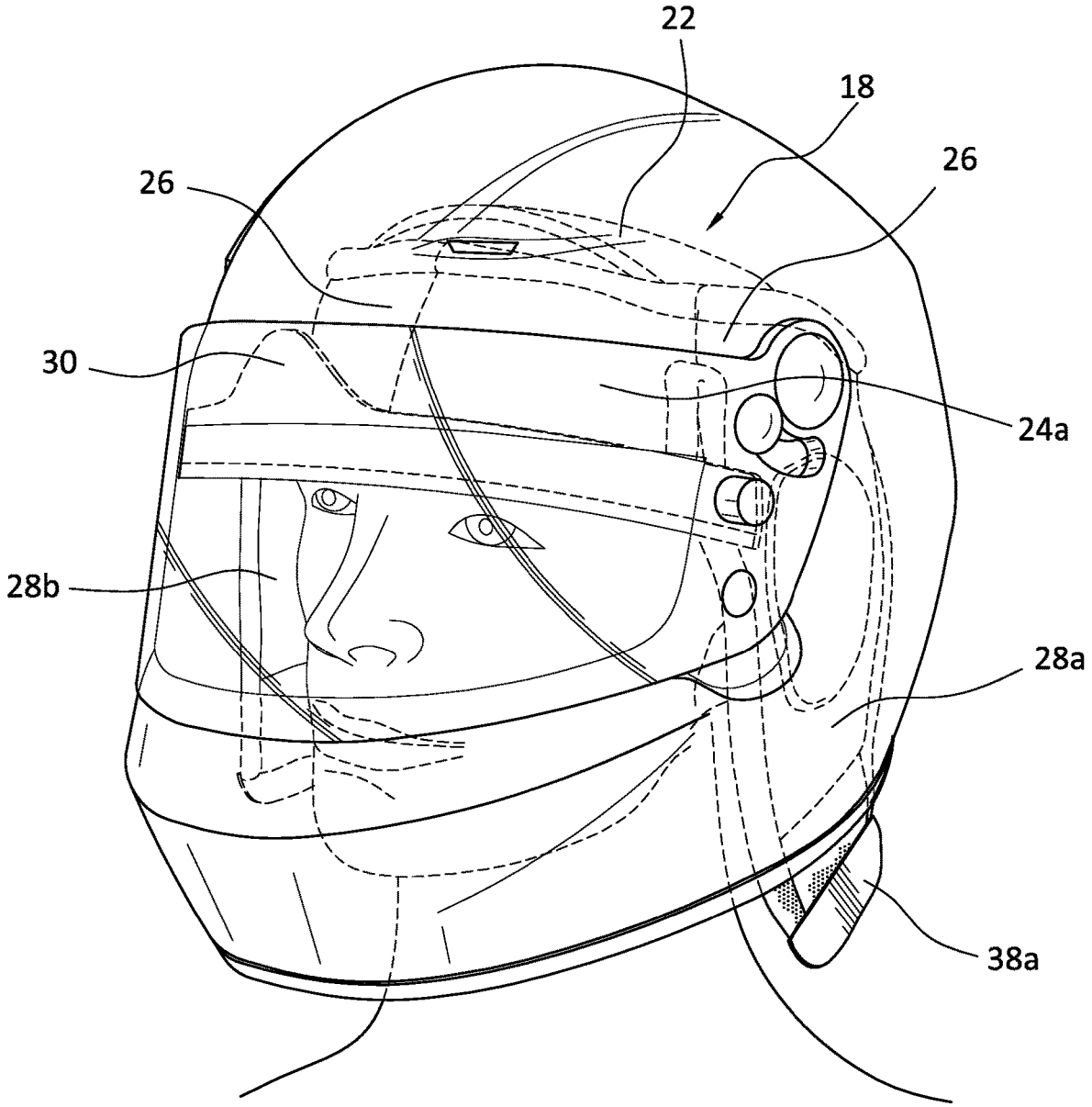
FIG. 5 is a perspective view illustrating a first phase of helmet removal by unfolding the side tab portions from the interior of the helmet.

As shown in FIG. 5, the dual tab portions 28*a* and 28*b* extend from the central portion 26 in a generally downward direction when the helmet liner 18 is in an attached position. Similar to that of the frontal portion 22 and the rear portion 34, the dual tab portions 28*a* and 228*b* each comprise a generally flexible structure permitting the tabs portions 28*a* and 28*b* to be folded into a storage position during normal operation, as shown in FIG. 4.

As shown the tab portions 28*a* and 28*b* each may include respective rigid end portions 38*a* and 38*b*. As shown in FIG. 4, the respective rigid end portions 38*a* and 38*b* span generally the width of the tab portions 28*a* and 28*b* and are configured for insertion into respective slots 40*a* and 40*b* formed between the interior shell 14 and the outer shell 16 of the helmet 12. As such, the slots 40*a* and 40*b* further facilitate in securing the helmet liner 18 to the interior shell 14 of the helmet 18. As shown, the respective rigid portions 38*a* and 38*b* have a generally flat thin planar configuration, however notably, it is contemplated that the rigid portions 38*a* and 38*b* may have virtually any desired shape without departing from the scope of the invention.

The helmet 12 or helmet liner 18 may each include a fastening means to secure the helmet liner 18 to the interior shell 14. In an embodiment shown in FIG. 2, it is contemplated that the helmet liner 18 may include one or more fastening device(s) 42, such as hook-and-loop, or snaps, for example, on the outer surface of the helmet liner 18. As such the fastening device 42 may be selectively provided on any or all of the frontal portion 20, rear portion 34, central portion 26, and/or top portion 22 of the helmet liner 18. It is further contemplated that the fastening device(s) 42 may be provided in the interior shell 14 to secure the helmet liner 18 to the interior shell 14.

In operation, the helmet removal system facilitates removal of the helmet 12 from the wearers head H by reducing the pulling action or force exerted on the head H in the longitudinal direction away from the neck N. The helmet liner 14 of the helmet removal system ejects the helmet by transferring lateral forces exerted on the helmet liner 14 dual tab portions 28*a* and 28*b* by an individual, such as medical personnel, into longitudinal forces simultaneously exerted on the user's head H and the respective outer edges 44*a* and 44*b* of the helmet 12, ejecting the helmet 12 from the head H.

Figure 6:
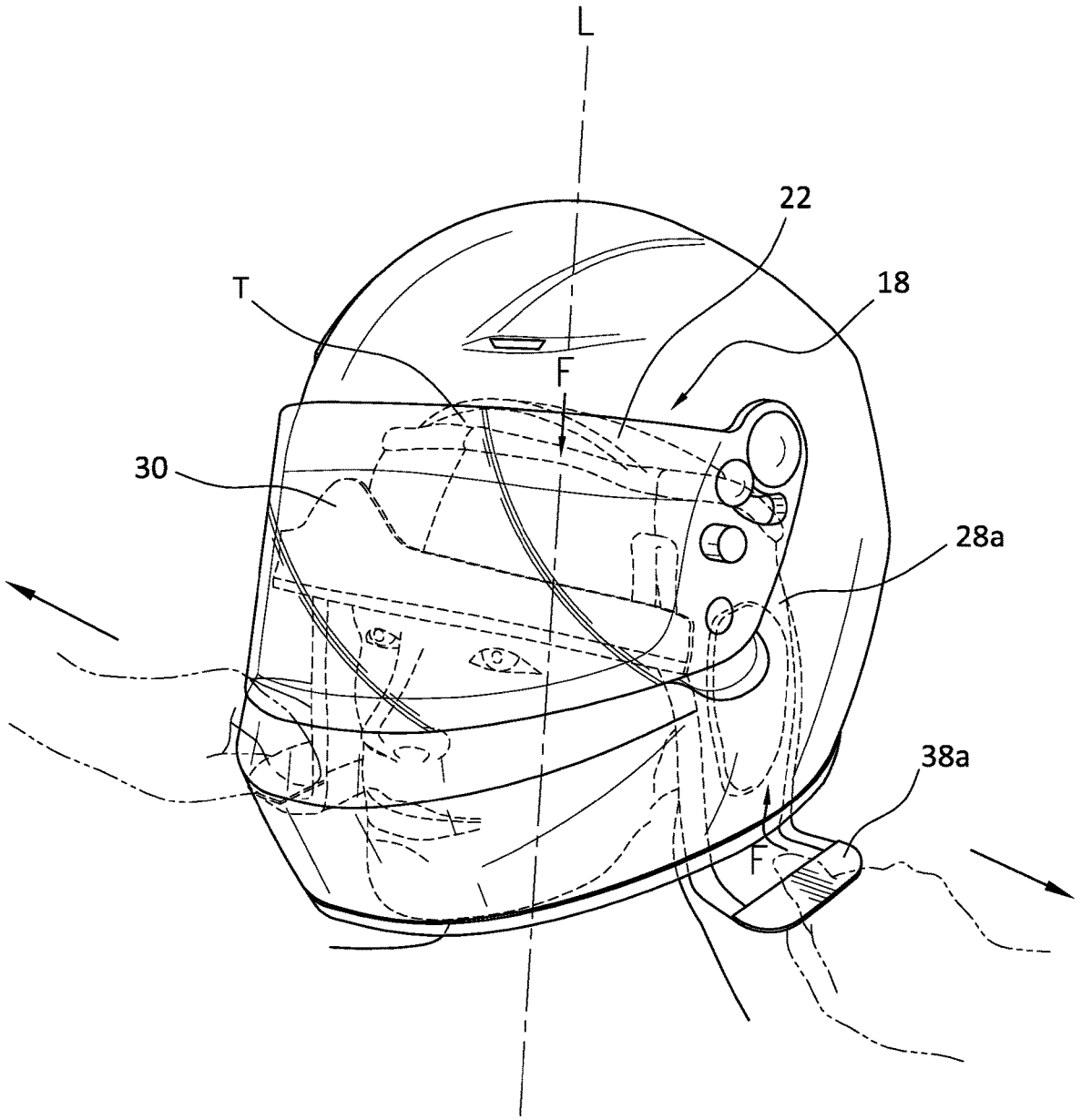
FIG. 6 is a perspective view illustrating a second phase of helmet removal illustrating the pulling of the side portions of the helmet liner in a generally lateral direction, perpendicular to the helmet.

As shown in FIG. 5, in a first phase of helmet removal, the dual tab portions 28*a* and 28*b* are released from the respective slots 38*a* and 38*b* formed between the inner shell 16 and outer shell 18 of the helmet 12. Once removed, the dual tab portions 28*a* and 28*b* are free for engagement by an individual assisting in helmet removal. Continuing now to FIG. 6, in a second phase, by applying a lateral pulling force on the dual tab portions 28*a* and 28*b*, generally perpendicularly from the head H and helmet 12, the dual tab portions 28*a* and 28*b* exert several counterbalancing forces on the helmet 12 and the head portion H simultaneously, ejecting the head H from the helmet 12.

Figure 7:
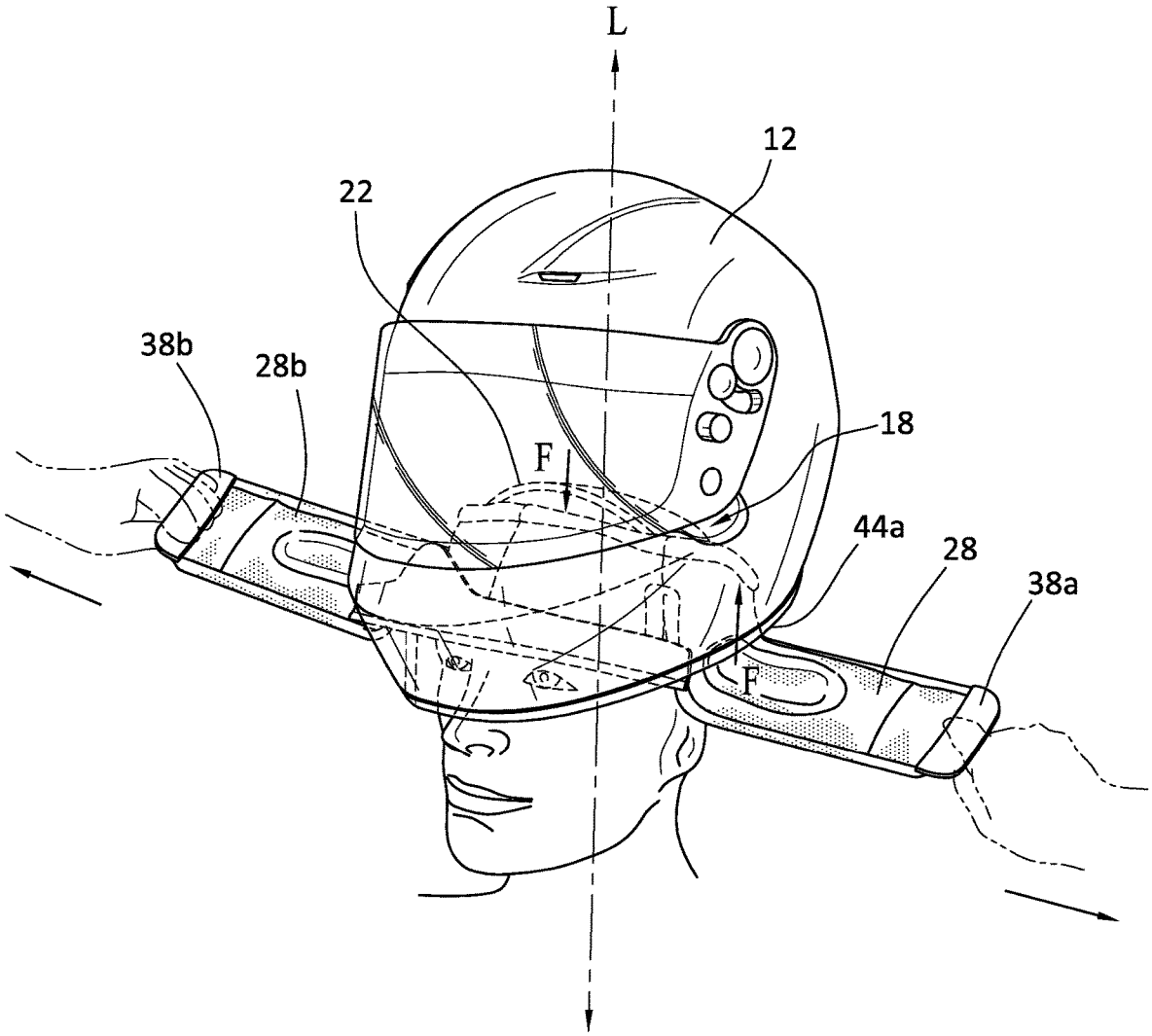
FIG. 7 is a perspective view illustrating a third phase of the removal of the helmet illustrating the side tab portions of the helmet liner at an ejected stage.

As further shown in FIG. 7, as an individual pulls on the tab portions 28*a* and 28*b* laterally, the tab portions 28*a* and 28*b* engage the respective outer edge(s) 44*a* and 44*b* of the helmet 12, applying a force on the helmet 12, forcing the helmet 12 in a first direction longitudinally away from the head H. Additionally, as the dual tab portions 28*a* and 28*b* are pulled general perpendicular to the helmet 12, the helmet liner 18 moves in an opposing second direction longitudinally towards the head H, applying force to the upper head region with the top head portion 22 and further apply forces to the frontal head region with the frontal portion 20 and with the back head region with the rear portion 34. Additionally, the central portion 26 of the helmet liner 18 applies an additional balancing and stabilizing force to the side regions of the head H further preventing displacement or migration of the head from the helmet liner 18 and further facilitating helmet removal.

Although the various exemplary embodiments have been described in detail with particular reference to certain exemplary aspects thereof, it should be understood that the invention is capable of other embodiments and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only and do not in any way limit the invention, which is defined only by the claims.

What is claimed is:

1. A helmet removal system to facilitate removal of a helmet, comprising:

a removably detachable helmet liner configured to be positioned in a helmet, the helmet liner including:

a central portion having a top edge, the central portion being configured to receive a user's head therein;

a frontal portion integrally formed with the central portion, and configured to engage a user's frontal head portion;

dual side tab portions integrally formed with the central portion and configured to be moved between a folded position inside of the helmet to an unfolded position;

a top portion configured to engage a top portion of the user's head, the top portion having two opposing ends which are each connected to the top edge of the central portion; and, a rear portion integrally connected to the central portion to provide a balancing engagement with the back of a user's head;

wherein the dual tab portions of the helmet liner are configured to engage a lower edge of the helmet when lateral pulling forces are applied to the dual tab portions, and apply a longitudinal force to the lower edge of the helmet in a first direction, forcing the helmet away from the user's head; and when the longitudinal force is applied to the lower edge of the helmet, the top portion of the helmet liner is configured to apply a longitudinal force on the user's head in an opposing second direction.

2. The helmet removal system of claim 1, wherein the rear portion of the helmet liner provides a balancing force to the back of the user's head when lateral forces are applied to the dual side tab portions.

3. The helmet removal system of claim 1, wherein the frontal portion of the helmet liner provides a balancing force to the front of the user's head when lateral forces are applied to the dual side tab portions.

4. The helmet removal system of claim 1, wherein the dual tab portions each have rigid end portions configured for insertion between an inner shell of the helmet and an outer shell of the helmet.

5. The helmet removal system of claim 1, wherein the central portion of the helmet liner defines a generally circular configuration adapted to receive a user's head therein.

6. The helmet removal system of claim 1, wherein the frontal portion of the helmet liner includes a flexible extension and a rigid portion configured for insertion into an interior portion of the helmet.

7. The helmet removal system of claim 1, wherein the top portion includes a first section and a second section.

8. The helmet removal system of claim 1, wherein a first opening is provided between the top portion and frontal portion and a second opening is provided between the top portion and the rear portion.

9. A method of removing a helmet from a user's head, comprising the steps of:

a. providing the helmet removal system of claim 1; and, b. applying lateral pulling forces to the dual tab portions such that longitudinal forces are applied to a lower edge of the helmet in a first direction and longitudinal forces are applied to a top portion of the user's head in an opposing second direction such that movement of the helmet and head in opposing directions ejects the helmet from the user's head.

10. The method of claim 9, further comprising the steps of:

c. applying lateral pulling forces to the dual tab portions such that the helmet liner in circumferential engagement with the head applies balancing forces on the frontal portion of the head and back portion of the head.

11. A helmet removal system to facilitate removal of a helmet, comprising:

a removably detachable helmet liner configured to be positioned in a helmet, the helmet liner including:

a central portion having a top edge, the central portion being configured to receive a user's head therein;

dual side tab portions integrally formed with the central portion and configured to be moved between a folded position inside of the helmet to an unfolded position;

a top portion configured to engage a top portion of the user's head, the top portion having two opposing ends which are each connected to the top edge of the central portion; and, wherein the dual tab portions of the helmet liner are configured to engage a lower edge of the helmet when lateral pulling forces are applied to the dual tab portions, and apply a longitudinal force to the lower edge of the helmet in a first direction, forcing the helmet away from the user's head; and when the longitudinal force is applied to the lower edge of the helmet, the top portion of the helmet liner is configured to apply a longitudinal force on the user's head in an opposing second direction.

* * * * *